US008353735B2

(12) United States Patent
Biousse

(10) Patent No.: US 8,353,735 B2
(45) Date of Patent: Jan. 15, 2013

(54) SUBMERGED BUOY

(75) Inventor: Patrice Biousse, La Roche de Glun (FR)

(73) Assignee: Peinture Industrielle Email au four ets Biousse, Bourg-les-Valences (FR)

( * ) Notice: Subject to any disclaimer, the term of this patent is extended or adjusted under 35 U.S.C. 154(b) by 119 days.

(21) Appl. No.: 12/675,934

(22) PCT Filed: Aug. 28, 2008

(86) PCT No.: PCT/FR2008/001213
§ 371 (c)(1),
(2), (4) Date: Oct. 25, 2010

(87) PCT Pub. No.: WO2009/060142
PCT Pub. Date: May 14, 2009

(65) Prior Publication Data

US 2011/0034094 A1 Feb. 10, 2011

(30) Foreign Application Priority Data

Aug. 31, 2007 (FR) ..... 07 06107

(51) Int. Cl.
*B63B 22/06* (2006.01)

(52) U.S. Cl. ..... 441/2; 367/4

(58) Field of Classification Search ..... 441/1, 2, 441/8; 367/4, 5
See application file for complete search history.

(56) References Cited

U.S. PATENT DOCUMENTS

| | | | | |
|---|---|---|---|---|
| 3,310,820 | A | 3/1967 | Anssi | |
| 4,189,786 | A * | 2/1980 | Adler | 367/4 |
| 5,100,353 | A * | 3/1992 | Domborwski et al. | 441/2 |
| 7,534,152 | B1 * | 5/2009 | Lloyd et al. | 441/2 |

OTHER PUBLICATIONS

International Search Report, European Patent Office, De Sena Hernandorena, The Netherlands, Aug. 21, 2009.

* cited by examiner

*Primary Examiner* — Lars A Olson
(74) *Attorney, Agent, or Firm* — BCF LLP

(57) ABSTRACT

This invention relates to a submerged buoy (1) consisting of: a housing (2) containing a receiver (4) of a radioacoustic signal; a mooring rope (11) with one end attached to a mooring point; a mechanism for releasing said buoy, allowing it to return to the surface; and a flotation reserve; said buoy being noteworthy in that the release mechanism (7) is of electromechanical type and is enclosed in a hermetically sealed tank (5) which thus forms the flotation reserve; said mechanism (7) controlling a catch (8) which either prevents or allows the free rotation of a winding drum (10) around which the mooring rope (11) is wound. This buoy may be used particularly for marking submerged objects such as fishing equipment, nets, fish pots etc., for controlling mooring sites in pleasure ports or even to mark off a sensitive area (such as around an underwater mine).

20 Claims, 1 Drawing Sheet

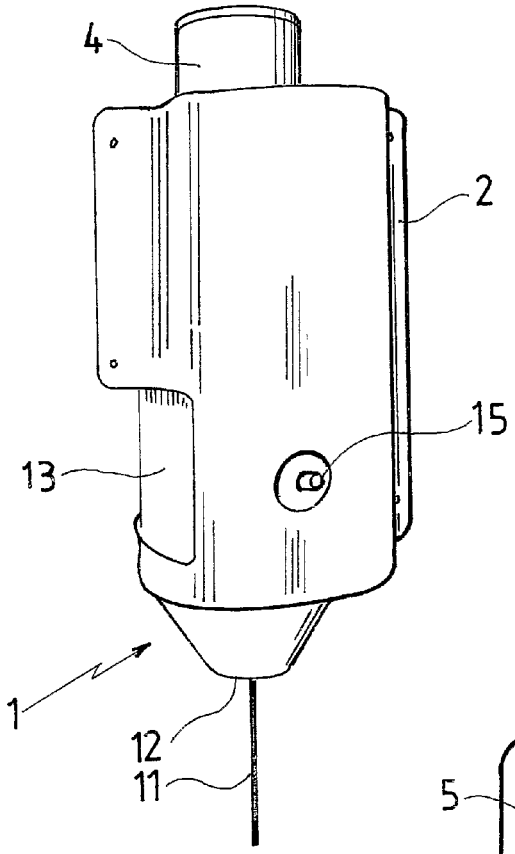
fig. 1
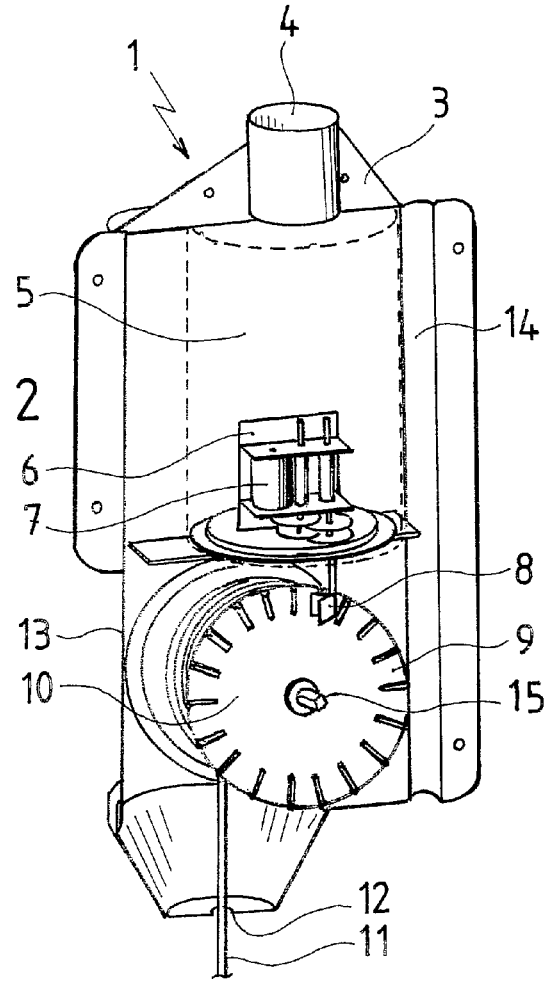
fig. 2
fig. 3
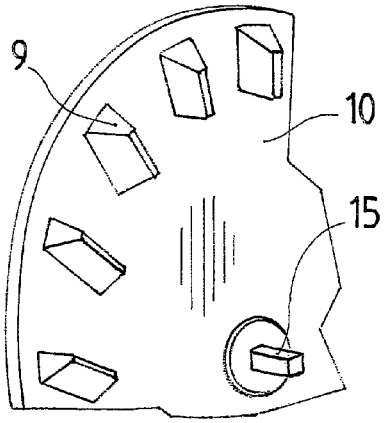

SUBMERGED BUOY

The subject matter of the present invention is a submerged buoy provided with means enabling it to rise to the surface on demand as well as a system for locating submerged objects using said buoy.

Such underwater buoy systems, enabling submerged objects to be located after triggering of a signal, are more particularly adapted for the location and recovery of submerged fishing equipment such as fishing lines, nets and pots, such as pots for fishing for crabs or lobsters. These submerged buoy systems advantageously enable fishermen to find their fishing equipment put in place while avoiding the normally encountered problems of losing signals that remain on the surface, as well as the theft of fishing equipment or the marking of favoured fishing areas, made possible by the display of surface signals.

Various technical solutions of submerged buoys have already been imagined.

Thus there is known, according to the U.S. Pat. No. 3,722,014, an underwater buoy comprising a mechanism for releasing a cord to which the buoy is attached, an acoustic-signal receiver triggering the release and a triggering system using explosives, the whole being enclosed in a cylindrical casing the bottom of which separates at the time of explosion in order to release the cord wound around the casing. In a second variant, the device comprises an inflatable buoy the inflation of which is triggered by the rupture of a valve connected to a gas cylinder at the time of explosion.

European patent EP 0.686.553 describes another release system in which a battery, in response to acoustic signals, triggers heating means in order to liquefy an expandable substance that will cause the movement of a lever for actuating the buoy release mechanism.

Release systems with mechanical controls are also known. Thus the U.S. Pat. No. 5,513,886 proposes an escape hook system the pivoting which is controlled by a motorised cam following the reception of the release signal; the U.S. Pat. No. 6,378,202 proposes for its part a clamp system the two arms of which are separated when the release signal is received.

Another example embodiment is given in the U.S. Pat. No. 3,310,820: the submerged buoy comprises a timer controlling a catch locking a drum around which a cable is wound connected to the float. Once the given time has elapsed, the catch is disengaged from the drum, which can then pay out.

Finally, the U.S. Pat. No. 6,880,290 proposes a solution preventing the loss of fishing pots, in which the underwater buoy is connected to the pot by biodegradable fasteners the complete disintegration of which is ensured after several weeks of immersion and thus makes it possible to find lost pots. On the other hand, this system does not include a controlled release device.

All these known systems are relatively complex on a mechanical level, do not necessarily offer the combining of different elements (buoy, acoustic reception signal, release mechanism) within the same casing, and generally represent a high operating cost.

The aim of the present invention is therefore to propose an alternative submerged buoy device comprising means ensuring rising to the surface thereof, of simple and robust design, easy to use and with a low cost price.

In this regard, the subject matter of the present invention is a submerged buoy consisting of a casing enclosing a receiver, a radio acoustic signal, a mooring rope attached at one of its ends to a mooring point, a mechanism for releasing the buoy enabling it to rise to the surface, and a flotation reserve, remarkable in that the release mechanism is of the electromechanical type and is enclosed in a hermetically received tank thus constituting the flotation reserve, said mechanism controlling a catch that either prevents or allows the free rotation of a winding drum around which the mooring rope is wound.

It will be understood clearly that the buoy according to the invention is therefore very simple in design and that its functioning is entirely reversible. In addition, it can be seen clearly that the rising to the surface initially caused by the floating reserve is then ensured by the space released by the unwinding of the mooring rope, thus increasing the buoyancy and accelerating the rise to the surface.

Other advantages and features will emerge more clearly from the following description of a variant embodiment of the submerged buoy according to the invention with reference to the accompanying drawings, in which:

FIG. 1 is a perspective view of the buoy according to the invention;

FIG. 2 is a partial view in longitudinal section of the buoy shown in FIG. 1;

FIG. 3 is an enlarged view in partial perspective of the plate of the winding drum carrying the teeth of the ratchet mechanism.

With reference to FIGS. 1 to 3, the buoy 1 according to the invention consists of a casing 2 with a roughly cylindrical shape. According to a particularly preferred variant, this casing 2 consists of two half-shells 3 assembled by screwing or riveting. Preferably, the form of the casing has a hydrodynamic profile that enables it advantageously to be insensitive to sea currents. This casing 2 contains in its top part a radioacoustic signal receiver 4. This receiver 4 fits on top of a hermetically sealed tank 5 (shown in broken lines in FIG. 2), which contains an electronic card 6 connected to the receiver 4, a battery (not shown) and a driving means consisting of a geared motor 7. The geared motor 7 drives a catch 8 cooperating with teeth 9 to form a ratchet mechanism, said teeth as shown enlarged in FIG. 3 being disposed at the periphery on the external face of one of the plates of the winding drum 10 around which a mooring rope 11 is wound to allow free unwinding thereof, when a suitable radioacoustic signal is sent to the receiver 4. A person skilled in the art will be able to use means other than a geared motor to implement the driving means, such as for example an electromagnet device, without departing from the scope of the present invention.

An outlet 12 for the mooring rope 11 is provided at the opposite end of the casing with respect to the receiver 4 and an access hatch 13 to the drum 10 is provided in a lateral wall of the casing 13. According to one feature of the invention, the rotation axis of the drum 10 is perpendicular to the longitudinal direction of the buoy, so that the rotation plane is parallel to the unwinding axis of the mooring rope 11.

With reference to FIG. 2, the casing 2 is provided with a longitudinal housing 14 intended to receive a balancing mast, not shown, and the location of the buoy 1 on the surface.

According to an advantageous feature of the invention, the winding drum 10 is mounted on a rotation shaft, one of the ends 15 of which, advantageously provided with a square driving bar, emerges outside the assembled casing 2, thus enabling the user to rewind the mooring rope 11 around the drum 10 using a portable electrical or manual tool such as a winch crank.

It will be understood clearly that the mechanical system of the invention is extremely reliable and can be reset very easily on a fishing boat by manual rewinding of the mooring rope 11 around the drum 10, and then sending a signal re-engaging the catch 8 in the teeth 9 of the drum 10 in order to lock rotation thereof. Naturally the resetting of the device can be controlled automatically by a timer.

According to a preferential feature, the battery is of the rechargeable accumulator type. This battery can be recharged by means of a sealed connection or by induction, according to the choice adopted by a person skilled in the art.

According to a variant, the beacon 1 is equipped with an additional device, not shown in the figures, added to the outside thereof, making it possible to adjust the immersion depth of said buoy 1. This device consists of a casing containing a winding motor associated with a depth meter and supplied by a self-contained battery, for example of the salt type, which affords constant electrical charging as soon as the buoy is submerged. The device will advantageously be disposed so that the winding motor is connected to the immerging end 15 of the rotation shaft of the drum 10. In a preferred variant (FIG. 3) where the catch 8 locks only the rotation of the said drum in the direction of unwinding of the mooring rope 11, the additional device will readjust the immersion depth of the buoy 1 either by procuring additional winding in order to make it descend, or by releasing the drum by sending a signal to the buoy 1 until it reaches a depth lower than the depth sought, and then winding the mooring rope until it reaches the required depth. Communication between the additional device can be cabled, by means of a sealed connection, or non-cabled, preferably by very short range waves. This additional depth control device advantageously avoids the loss of a submerged buoy in the event of error in dropping it in an area where it would be situated at a depth greater than the planned length of the mooring rope 11, which would prevent the buoy rising to the surface again and therefore being recovered. In addition, in the case of tides, this additional device makes it possible to precisely adjust the length of cable necessary for the mooring rope 11 so that buoy 1 arrives on the surface and therefore limits the surface drift of said buoy when the latter is released.

According to an addition feature, the buoy 1 is equipped with a security system for cases of electrical failure relating to a problem of charging the batteries controlling the geared motor 7 or a sealing problem, this device giving rise to the automatic disengagement of the catch 8 and thus the rising of the buoy 1 to the surface.

The buoy device according to the invention will preferably be used in a system for locating submerged objects.

The second subject matter of the present invention is therefore a system for locating submerged objects by means of submerged buoys giving off a surface signal following the reception of acoustic triggering signals, said system comprising a transmitter and a set of buoys. This location system is remarkable in that, firstly, the transmitter consists of a transmitting unit connected to a submerged transducer and, secondly, the buoys are as described previously.

This particular configuration of a transmitter advantageously makes it possible to have an omnidirectional transmission radius.

Preferably, the transmitting unit will comprise a module for the automatic transmission of the buoy activation codes, for example in connection with a global positioning system (GPS). In addition, a function of activating all the buoys present on a site can be provided, transmitting successively all the signal codes provided. Preferably, the transmission system makes it possible to manage more than 64,000 triggering codes with a single frequency, which makes it possible to individualise the code for triggering each of the buoys.

In a practical fashion, the range of the system will be more than 500 meters, optimally with a transmission radius of approximately 800 meters.

The system for locating submerged objects according to the invention therefore advantageously makes it possible to manage a fleet of buoys with a single transmitter, which substantially reduces the cost of using this system and ensures profitability of the investment for the users. In addition, it will be understood clearly that the large number of codes managed by the transmission system ensures security of the device where several users of the system according to the invention frequent geographical areas that are close together or identical.

In the case of a fishing boat, the transducer of the location system will be positioned under the hull in the last rear third of the boat: this is because this part is the least exposed to turbulence when the boat is moving.

Finally, the transmitter unit comprises a user interface, with in particular a keyboard and a display screen for offering the user various options for managing the triggering codes.

It will be understood clearly that the main application of the submerged buoy according to the invention is intended for submerged fishing equipment. However, the invention will advantageously find another application in the management of mooring locations, that is to say rings in marinas. The submerged buoys according to the invention will be associated with a central transmitting system linked to a server and to a bank terminal, which will trigger the rise of a submerged buoy carrying a ring connected to a mooring cable, following the payment required for the obtaining of a place in the marina.

The system according to the invention can also be used for neutralising accesses to certain areas such as channels or gangplanks along which boats may be moored. However, in this application, it will be necessary to provide a supplementary external casing with a motor driving the winding of the mooring rope 11 around the drum 10 in order to submerge the buoy 1, the system being idle and on the surface when access must be prohibited. It will also be possible to envisage using the buoy according to the invention for limiting a sensitive area as required, for example a wreck or sea mines.

Finally, it goes without saying that the embodiment of the buoy 1 according to the invention is merely a particular variant, in no case limitative of adaptations that a person skilled in the art could make thereto.

The invention claimed is:

1. Submerged buoy comprising a casing containing a radioacoustic signal receiver, a mooring rope attached at one of its ends to a mooring point, a mechanism for releasing said buoy enabling it to rise to a surface, and a flotation reserve, the release mechanism being of the electromechanical type and being contained in a hermetically sealed tank thus constituting the flotation reserve, said mechanism controlling a catch which either prevents or allows the free rotation of a winding drum around which the mooring rope is wound.

2. Buoy according to claim 1, wherein the release mechanism is a geared motor driving the catch which, by engaging with teeth disposed at a periphery on an external face of a plate of the drum, forms a ratchet mechanism ensuring the free unwinding of the mooring rope when a suitable radio acoustic signal is sent to the receiver, and conversely locking thereof after rewinding of said mooring rope around the drum.

3. Buoy according to claim 1, wherein a rotation axis of the drum is perpendicular to the longitudinal direction of the buoy.

4. Buoy according to claim 1, wherein one of the ends of a rotation axis of the drum emerges outside the casing, enabling the mooring rope to be rewound around the drum by means of a portable electric or manual tool.

5. Buoy according to claim 4, further comprising an additional device mounted outside the buoy enabling its submersion depth to be adjusted.

6. Buoy according to claim 5, wherein the additional device comprises a winding motor intended to be connected to the end of the shaft of the drum and associated with a depth meter, supplied by a self-contained battery.

7. Buoy according to claim 1, wherein said buoy is equipped with a system for security against electrical or sealing failures, consisting of automatically disengaging the catch.

8. System for locating submerged objects by means of submerged buoys provided with a surface signal that can be read following the reception of acoustic signals, said system comprising a transmitter and said buoys being equipped with receivers, the transmitter having a transmitting unit connected to a submerged transducer and wherein the submerged buoys being those defined in claim 1.

9. A method for managing mooring locations in a marina, the method comprising:

receiving payment in exchange for a mooring location; and sending a signal to a submerged buoy so as to trigger rising of the submerged buoy, the signal being sent by a central transmitter connected to a server and to a bank terminal, the submerged buoy carrying a ring connected to a mooring cable and to the central transmitter, the submerged buoy being the buoy according to claim 1.

10. Buoy according to claim 2, wherein a rotation axis of the drum is perpendicular to the longitudinal direction of the buoy.

11. Buoy according to claim 2, wherein one of the ends of a rotation axis of the drum emerges outside the casing, enabling the mooring rope to be rewound around the drum by means of a portable electric or manual tool.

12. Buoy according to claim 3, wherein one of the ends of a rotation axis of the drum emerges outside the casing, enabling the mooring rope to be rewound around the drum by means of a portable electric or manual tool.

13. System for locating submerged objects by means of submerged buoys provided with a surface signal that can be read following the reception of acoustic signals, said system comprising a transmitter and said buoys being equipped with receivers, wherein the transmitter has a transmitting unit connected to a submerged transducer and wherein the submerged buoys are those defined in claim 2.

14. System for locating submerged objects by means of submerged buoys provided with a surface signal that can be read following the reception of acoustic signals, said system comprising a transmitter and said buoys being equipped with receivers, the transmitter has a transmitting unit connected to a submerged transducer and wherein the submerged buoys are those defined in claim 3.

15. System for locating submerged objects by means of submerged buoys provided with a surface signal that can be read following the reception of acoustic signals, said system comprising a transmitter and said buoys being equipped with receivers, wherein the transmitter has a transmitting unit connected to a submerged transducer and wherein the submerged buoys are those defined in claim 5.

16. System for locating submerged objects by means of submerged buoys provided with a surface signal that can be read following the reception of acoustic signals, said system comprising a transmitter and said buoys being equipped with receivers, wherein the transmitter has of a transmitting unit connected to a submerged transducer and wherein the submerged buoys are those defined in claim 7.

17. A method for managing mooring locations in a marina, the method comprising:

receiving payment in exchange for a mooring location; and sending a signal to a submerged buoy so as to trigger rising of the submerged buoy, the signal being sent by a central transmitter connected to a server and to a bank terminal, the submerged buoy carrying a ring connected to a mooring cable and to central transmitter, the submerged buoy being the buoy according to claim 2.

18. A method for managing mooring locations in a marina, the method comprising:

receiving payment in exchange for a mooring location; and sending a signal to a submerged buoy so as to trigger rising of the submerged buoy, the signal being sent by a central transmitter connected to a server and to a bank terminal, the submerged buoy carrying a ring connected to a mooring cable and to central transmitter, the submerged buoy being the buoy according to claim 3.

19. A method for managing mooring locations in a marina, the method comprising:

receiving payment in exchange for a mooring location; and sending a signal to a submerged buoy so as to trigger rising of the submerged buoy, the signal being sent by a central transmitter connected to a server and to a bank terminal, the submerged buoy carrying a ring connected to a mooring cable and to central transmitter, the submerged buoy being the buoy according to claim 5.

20. A method for managing mooring locations in a marina, the method comprising:

receiving payment in exchange for a mooring location; and sending a signal to a submerged buoy so as to trigger rising of the submerged buoy, the signal being sent by a central transmitter connected to a server and to a bank terminal, the submerged buoy carrying a ring connected to a mooring cable and to central transmitter, the submerged buoy being the buoy according to claim 7.

* * * * *